US009933222B2

(12) United States Patent
Hirschheiter

(10) Patent No.: US 9,933,222 B2
(45) Date of Patent: Apr. 3, 2018

(54) CATCH DEVICE FOR THE BREECH OF A PISTOL

(71) Applicants: Glock Technology GmbH, Deutsch Wagram (AT); Elisabeth Hirschheiter, Pörtschach (AT)

(72) Inventor: Reinhold Hirschheiter, Pörtschach (AT)

(73) Assignee: Glock Technology GmbH (AT)

( * ) Notice: Subject to any disclaimer, the term of this patent is extended or adjusted under 35 U.S.C. 154(b) by 52 days.

(21) Appl. No.: 14/567,896

(22) Filed: Dec. 11, 2014

(65) Prior Publication Data

US 2015/0192378 A1 Jul. 9, 2015

(30) Foreign Application Priority Data

Dec. 11, 2013 (EP) ..... 13196708

(51) Int. Cl.
*F41A 17/36* (2006.01)

(52) U.S. Cl.
CPC ..... *F41A 17/36* (2013.01)

(58) Field of Classification Search
CPC ..... F41A 17/36; F41A 17/40; F41A 17/42; F41A 3/70; F41A 17/34
USPC ..... 42/7, 70.01–70.02; 89/137–138
See application file for complete search history.

(56) References Cited

U.S. PATENT DOCUMENTS 1,176,254 A * 3/1916 Smith ..... F41A 3/12 42/7
1,359,365 A * 11/1920 Hammond ..... F41A 3/64 42/7
1,381,590 A * 6/1921 Oliver ..... F41A 3/44 42/69.03
1,405,685 A * 2/1922 Hammond ..... F41A 17/38 42/7
2,538,799 A * 1/1951 Phillips ..... F41A 17/36 89/138
2,975,680 A * 3/1961 Wilson ..... F41A 3/38 42/25
3,069,976 A * 12/1962 Stevens, Jr. ..... F41A 3/40 42/18
3,109,345 A 11/1963 Norman
3,540,142 A * 11/1970 Billett ..... F41A 7/02 42/18

(Continued)

FOREIGN PATENT DOCUMENTS

EP 0077790 A1 5/1983
EP 0268276 A2 * 5/1988 ..... F41A 3/66

*Primary Examiner* — Troy Chambers
*Assistant Examiner* — Benjamin S Gomberg
(74) *Attorney, Agent, or Firm* — Kolisch Hartwell, P.C.

(57) ABSTRACT

A catch device for the breech of a pistol, in which a spring acts upon a pivotable holding lever so that the latch thereof passes out of the path of the breech and the handle thereof is pressed away from the breech. Part of the holding lever is pivoted by the magazine slide, after the final cartridge has been pushed in counter to the force of the spring, so that after the cartridge has been fired, the breech is caught against the latch and remains in the region of the rear end position thereof. In order to increase service life, the spring is a compression spring, pretensioned between two claws of the holding lever and arranged in a slot of the housing so that one end bears against the base of the slot and the other end bears against the claw.

4 Claims, 4 Drawing Sheets

(56) References Cited

U.S. PATENT DOCUMENTS

Figure 1:
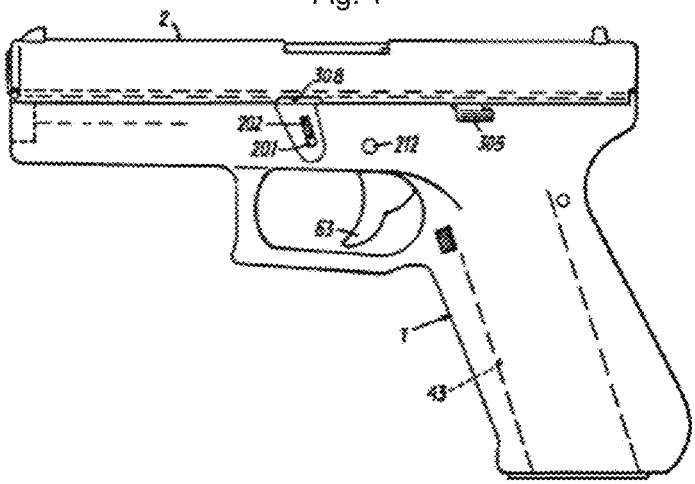

| | | | | | |
|---|---|---|---|---|---|
| 3,688,640 | A * | 9/1972 | Seecamp | F41A 9/18 | 89/138 |
| 4,539,889 | A | 9/1985 | Glock | | |
| 4,619,062 | A * | 10/1986 | Johnson | F41A 17/42 | 42/49.02 |
| 4,825,744 | A | 5/1989 | Glock | | |
| 4,893,546 | A | 1/1990 | Glock | | |
| 7,228,780 | B1 * | 6/2007 | Thomele | F41A 17/42 | 42/70.01 |
| 7,299,581 | B2 * | 11/2007 | LaFleur | F41A 3/46 | 42/70.02 |
| 8,701,324 | B1 * | 4/2014 | Viani | F41A 17/36 | 42/16 |
| 9,207,032 | B2 * | 12/2015 | Curry | F41A 17/36 | |

* cited by examiner

PRIOR ART

CATCH DEVICE FOR THE BREECH OF A PISTOL

The invention relates to a catch device for the breech of a pistol, according to the preamble of the claim and to the applicant's U.S. Pat. No. 4,825,744 A, U.S. Pat. No. 4,893,546 A and U.S. Pat. No. 4,539,889 A, and the content of said three documents is incorporated by reference in the content of the present application for the jurisdictions in which this is possible.

EP 268 276 (corresponding to CA 1 329 332, the content of this document is incorporated by reference in the content of the present application for the jurisdictions in which this is possible) discloses a catch device for the breech of a pistol, in which a lever is mounted pivotably about the axis of the trigger lever and, in the rear region thereof, as seen from the gun, firstly has a catch nose for the sliding carriage or breech of the pistol and, secondly, has a stop surface for a buffer of the magazine slide. A compression spring is provided in the front region, at a distance in front of the trigger slide, said compression spring acting at one end on the lever and at the other end on the frame of the pistol and pressing the catch nose out of the path of movement of the sliding carriage. Only when the last shot has been fired is said compression spring pushed upwards by the buffer of the magazine, which is now empty, and catches the sliding carriage for the changing of the magazine. This arrangement requires a large amount of space, especially between the trigger lever and the barrel, i.e. has a greatly raised construction, and therefore the pistol has the tendency to "jerk". Furthermore, the lever is subjected to a bending stress over the entire length thereof, and therefore has to be of relatively solid design.

U.S. Pat. No. 3,109,345, the content of said document is incorporated by reference in the content of the present application for the jurisdictions in which this is possible, discloses a catch device in which the restoring spring of the pistol presses via a type of spring plate against a laterally flattened spindle of the catch device, thus fixes the angular position of the latter frictionally and thereby pushes the catch nose thereof out of the path of movement of the sliding carriage. After the final round, because of the large lever arm, a pin of the carrier in the magazine pivots the catch device, in spite of the vigorous restoring spring, and the catch nose of said catch nose catches the sliding carriage. This construction requires an extremely complex and easily soiled design of the region between restoring spring and catch nose, both as far as the frame of the pistol and the individual components are concerned. The transmission of the torque via the flattened portion to the lever is especially extremely problematic.

The disclosure of the applicant's three US publications mentioned at the beginning corresponds to that of EP 77 790 of the applicant. Said document, in FIGS. 24, 27 and 28, which are incorporated in the present application as FIGS. 1, 2 and 3 in order to explain the prior art, shows a catch device of this type and describes the latter as follows:

"A device can also be provided which ensures the rapid readiness for firing when the cartridge magazine is changed. For this purpose, a lever which is referred to overall by 301 and is articulated on the spindle 212 of the trigger lever 63 is provided. The trigger lever 63 has a lateral recess 302 for this purpose. The lower side of the lever 301 is provided with a hook 303 into which the end of a hairpin spring 304 is hooked, the hairpin spring partially wrapping around the spindle 212 and being latched in a groove of the web 210. This spring attempts to pivot the lever 301 into the lower end position thereof, in which a handle 305 rests in a recess 306 of the gripping piece 1. Furthermore the upper side of the lever 301 has a nose 307 which projects into the path of movement of the slide which is under spring tension in the cartridge magazine and attempts to push the cartridges upwards. If the final cartridge of the magazine is pushed into the barrel, the slide of the magazine strikes against the nose 307 of the lever 301 and attempts to pivot the latter upwards. The lever 301 is prevented from participating in said pivoting movement by the lower edge of the sliding carriage 2. After the cartridge has been fired, the lever 301 enters a recess 308 on the lower edge of the sliding carriage 2 when the latter is in the end position thereof. The lever 301 therefore blocks the sliding carriage 2 against a rapid advance. As a consequence of the articulation of the lever 301 on the spindle 212, see FIG. 24, the block is maintained even when the magazine has been pulled out and replaced by a new magazine. As soon as the lever 301 is pivoted downwards by means of the handle 305, the sliding carriage 2 moves forwards under the action of the restoring spring 14 and pushes the first cartridge of the new magazine into the barrel. The sliding carriage therefore no longer needs to be pulled upwards after the cartridge magazine has been changed."

This device has been tried and tested for over thirty years in a hundred thousand copies, but, in particular in the case of the products in question, engineers constantly strive to further improve the individual elements and assemblies and, in particular, to increase the service life thereof and, as far as possible, to further simplify the handling by the user.

These are the objects of the present invention.

These objects are achieved according to the invention by the features and characteristics specified in the characterizing part of the claim; in other words, the hairpin spring from the prior art, the mounting of which does require some skill, is replaced by a pretensioned helical spring connected fixedly to the holding lever. The construction of the catch device is therefore simplified and the service life thereof is further significantly increased since the sliding movement between the ends of the hairpin spring and the stops thereof is avoided; when the pretensioned helical spring is tensioned further, there is virtually no relative movement between the ends of the spring and the adjacent components. All of the force profiles and the introduction of torques are optimally achieved.

Figure 2:
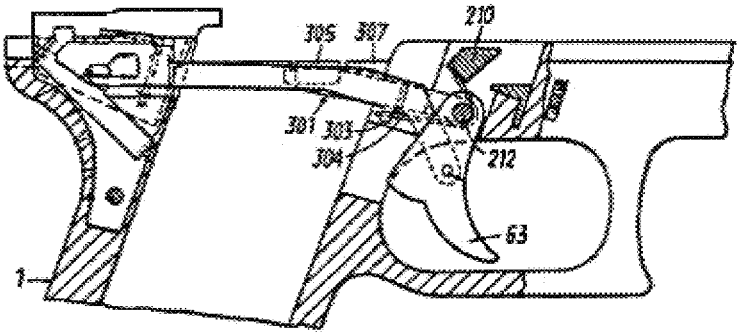
PRIOR ART Fig. 2
Figure 3:
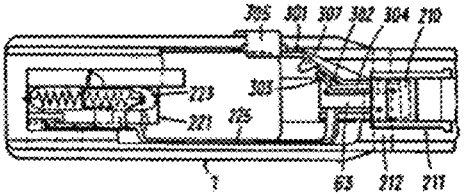
PRIOR ART Fig. 3
Figure 4:
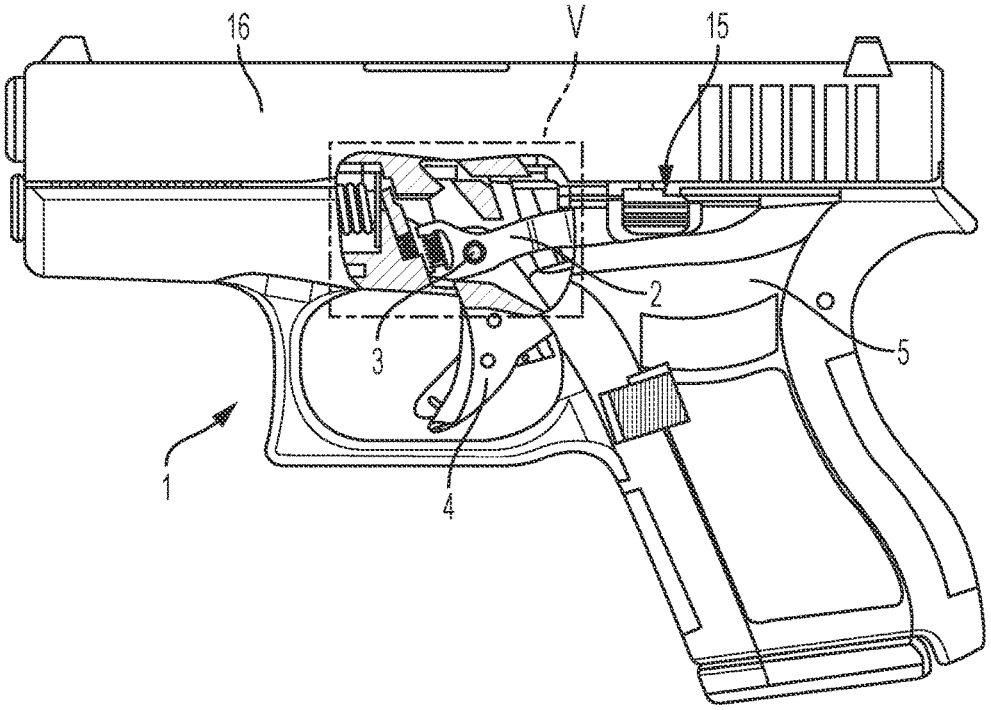
Figure 6:
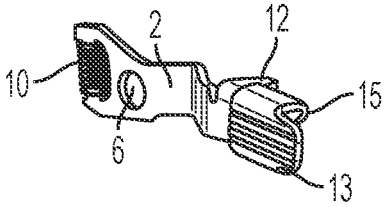
Figure 5:
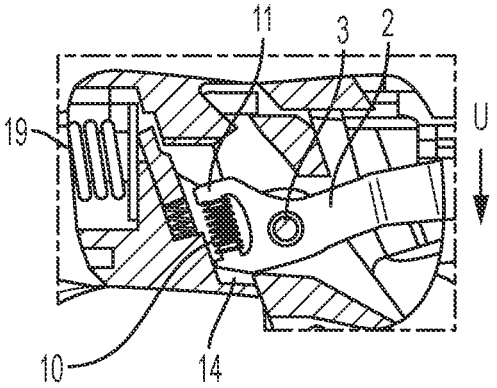
Figure 7:
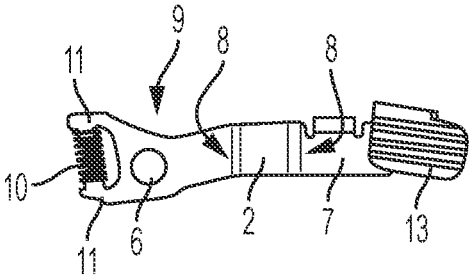
Figure 8:
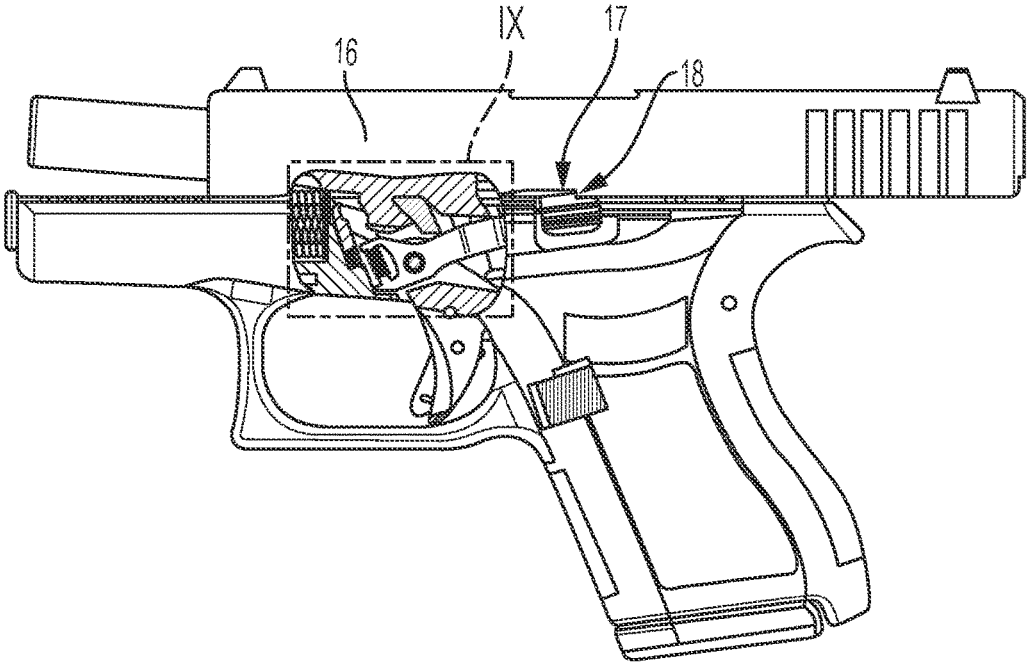
Figure 9:
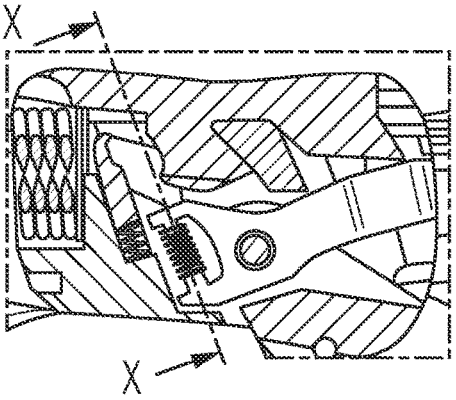
Figure 10:
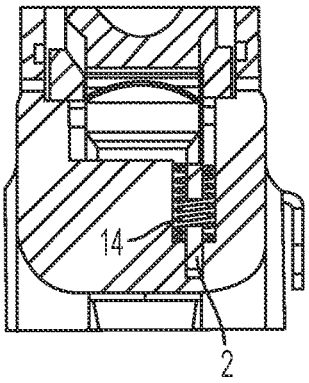

The invention is explained in more detail below, wherein reference is made to the attached drawing, in which:

FIGS. 1 to 3 show the prior art,

FIG. 4 shows a catch device according to the invention in a view similar to FIG. 1, partially in section, FIG. 5 shows the detail V from FIG. 4, FIGS. 6 and 7 show the holding lever in two different views, FIG. 8 shows an illustration according to FIG. 4 in an active catch position, FIG. 9 shows the detail IX from FIG. 5, but in the position of FIG. 8, and FIG. 10 shows the section X-X from FIG. 9.

FIGS. 1 to 3 illustrate the prior art and have been explained in detail further above.

FIG. 4 shows an illustration of a pistol 1 in a similar manner as in FIG. 1, partially opened up and in section, and provided with a catch device according to the invention. The core of this device is a holding lever 2 which is mounted rotatably about a spindle 3. The exemplary embodiment illustrated involves the rotating spindle of the trigger lever 4; in the case of pistols in which the trigger lever is not pivotable about a rotating spindle, but is mounted displaceably in a guide, an appropriate rotating spindle has to be provided in the housing 5 of the pistol 1.

The holding lever 2 is illustrated in detail in FIGS. 6 and 7; FIG. 6 shows a perspective view and FIG. 7 shows a side view. In the exemplary embodiment illustrated, the holding lever 2, as in the prior art, consists of an appropriately configured piece of sheet metal and has an elongate and offset shape. The offset can readily be seen in particular from FIG. 6 and is indicated in FIG. 7 by the bending edges 8. The end regions, a spring part 9 and a holding part 7, run at least approximately parallel to each other, and a rotational opening 6, through which the rotating spindle 3 projects in the fitted state, is provided in the spring part 9.

On the spring part 6, a compression spring 10 is clamped in a pretensioned state between the end regions of the spring part 9, which end regions are designed to form two claws 11, 11'. The two claws 11, 11' here each have holding extensions which are directed towards each other, lie in the interior of the helical spring 10 and hold the latter. The pretensioning of the compression spring 10 is achieved by the fact that the relaxed length thereof is greater than the distance between those regions of the claws 11, 11' against which the ends of the spring 10 bear.

At the other end of the holding lever 2, the holding section or holding part 7, the latter is formed in a known manner. It has a holding wing 12 which runs substantially normally to the two at least approximately parallel planes of the holding part 7 and of the spring part 9 and, in the mounted state of the holding lever 2, is directed into the interior of the housing of the pistol. A handle 13 is also arranged in this region of the holding lever 2, at yet a greater distance from the rotational opening 6 in the exemplary embodiment illustrated. Said handle, as is readily apparent in particular from FIG. 6, consists of a holding part section which is bent over through 180° about the approximate longitudinal axis of the holding lever 2 and forms a latch 15.

As is clear from an overall view of FIGS. 5, 9 and 10, the holding lever 2 is inserted with the spring part 9 thereof and the compression spring 10 into a slot 14 of the housing 5 of the pistol 1. Said slot 14 is expanded in the region in which the compression spring 10 comes to lie (FIG. 10) and forms an abutment for the compression spring 10. Since the other abutment is formed by the claw 11, the compression spring 10 in the fitted state attempts to rotate the holding lever 2 in the clockwise direction about the rotating spindle 3. The result is, as is apparent from FIG. 4, that the latch 15 lies below the lower edge of the sliding carriage 16 and does not impair the movement of the sliding carriage 16.

When the final cartridge from the magazine is fired, the slide located in the magazine pushes the actuating wing 12 under the action of the magazine spring upwards anticlockwise about the rotating spindle 3 counter to the force of the compression spring 10, but this does not lead to any movement of the holding lever 2 at the beginning of the recoil of the sliding carriage 16 since the wing bears against the lower side of the sliding carriage. Only when the handle 13 and, with the latter, the latch 15 pass into the region of a recess 17 of the sliding carriage is the holding lever pivoted, as is apparent from FIG. 8, and, as the sliding carriage 16 moves forwards under the action of the restoring spring 19, catches the sliding carriage 16 against the impact surface 18 of the recess 17. This situation is maintained even if the empty magazine is subsequently removed and replaced by a full or partially filled one. After the new magazine containing cartridges has been inserted, the handle 13 is moved downwards manually, as a result of which the sliding carriage 16 is pulled forwards by the restoring spring 19 and, in the process, pushes the first cartridge of the new magazine into the chamber, and the situation is again the situation which is shown in FIG. 4.

In summary, it can be stated that the invention relates to a catch device for the breech of a pistol, in which a spring 10 attempts to pivot a holding lever 2, which is mounted pivotably in the housing 5 of the pistol, in such a manner that an impact surface 18, which is formed on the upper side thereof directed towards the breech, passes out of the path of the breech, and a handle 13 provided on the holding lever 2 is pressed downwards, away from the breech 16, wherein part of the holding lever projects into the path of movement of a magazine slide, which presses the cartridges towards the breech, and is acted upon by said magazine slide, after the final cartridge of the magazine has been pushed in counter to the force of the spring 10, in such a manner that, during the return movement after said cartridge has been fired, the breech is caught by a recess 17 on the impact surface 18 and remains in the region of the rear end position thereof. The invention in essence consists here in that the spring 10 is a compression spring which, pretensioned between two claws 11, 11' of the holding lever 2, is arranged in a slot 14 of the housing 5 and bears at one end thereof against the base of the slot 14 and at the other end thereof against the claw 11.

List of Designations:

| | |
|---|---|
| 01 | Pistol |
| 02 | Holding lever |
| 03 | Rotating spindle |
| 04 | Trigger lever |
| 05 | Frame, housing |
| 06 | Rotational opening |
| 07 | Holding part |
| 08 | Bending edge |
| 09 | Spring part |
| 10 | Spring, compression spring |
| 11, 11' | Claw |
| 12 | Holding wing, actuating wing |
| 13 | Handle |
| 14 | Slot |
| 15 | Latch |
| 16 | Sliding carriage, breech |
| 17 | Recess |
| 18 | Impact surface |
| 19 | Restoring spring |
| U | Clockwise direction |

What is claimed:

1. A pistol, comprising:

a catch device for a sliding carriage of the pistol, the catch device including a holding lever and a spring which attempts to pivot the holding lever, where the holding lever includes a spring end and a holding end; the spring end having an upper claw and a lower claw that are directed towards each other and the spring being a compression spring that is pretensioned between the upper claw and the lower claw of the holding lever; and the holding lever is mounted pivotably in a housing of the pistol, in such a manner that a latch, which is formed on an upper side thereof directed towards the sliding carriage, passes out of a path of the sliding carriage, and a handle provided on the holding lever is pressed downwards, away from the sliding carriage, wherein a part of the holding lever projects into a path of movement of a magazine slide that is configured to urge cartridges within a magazine towards the sliding carriage, and is acted upon by said magazine slide, after a final cartridge of the magazine has been pushed in counter to a force of the spring, in such a manner that, during a return movement after said cartridge has been fired, the sliding carriage is caught by a recess on the latch and remains in a region of a rear end position thereof; wherein the compression spring is arranged in a slot of the housing and bears at a lower end thereof against a base of the slot and at an upper end thereof against the upper claw.

2. A pistol having a catch device to retain a sliding carriage of the pistol, the pistol comprising:

a holding lever having a first end and a second end;

wherein the first end includes a lower claw and an upper claw disposed in opposition to each other, and a pretensioned compression spring disposed between and retained by the lower and upper opposed claws;

wherein the second end includes a holding portion that comprises a latch disposed on an upper side of the holding portion, and a handle;

wherein the holding lever is pivotally mounted in a housing of the pistol so that the compression spring is disposed in a slot of the pistol housing, one end of the compression spring bears against a base of the slot, and the other end of the compression spring bears against the upper claw, thereby applying a bias to the holding lever that urges the holding portion downwards and away from the sliding carriage, so that the latch is out of a path of the sliding carriage;

and wherein a part of the holding lever projects into a path of movement of a magazine slide of the pistol, wherein the magazine slide is configured to urge cartridges within a magazine towards the sliding carriage, and the holding lever is further configured such that after a final cartridge of the magazine has been urged towards the sliding carriage the magazine slide will act upon the holding lever to move the holding lever counter to the bias applied by the compression spring, so that after the final cartridge is fired and during the return movement of the sliding carriage, the latch is urged into a corresponding recess in the sliding carriage thereby retaining the sliding carriage in the sliding carriage's rearward position.

3. The pistol of claim 2, wherein the compression spring is a helical compression spring, and the lower claw and the upper claw comprise holding extensions that extend into an interior of the helical compression spring and thereby secure the spring.

4. The pistol of claim 2, wherein the holding lever is configured so that the sliding carriage is retained in the sliding carriage's rearward position until the handle of the holding lever is manually moved downwards, thereby releasing the sliding carriage.

* * * * *